US005286682A

United States Patent [19]

Jacobs et al.

[11] Patent Number: 5,286,682

[45] Date of Patent: Feb. 15, 1994

[54] YELLOW RETROREFLECTIVE PAVEMENT MARKINGS

[75] Inventors: Gregory F. Jacobs, Woodbury; James E. Lasch, Oakdale; Thomas P. Hedblom, Eagan, all of Minn.; Larry K. Stump, Hudson, Wis.

[73] Assignee: Minnesota Mining and Manufacturing Company, St. Paul, Minn.

[21] Appl. No.: 838,527

[22] Filed: Feb. 19, 1992

[51] Int. Cl.[5] ..... C03C 12/02

[52] U.S. Cl. ..... 501/34; 106/436; 106/482

[58] Field of Search ..... 501/34; 106/436, 450, 106/482

[56] References Cited

U.S. PATENT DOCUMENTS

| | | | |
|---|---|---|---|
| 3,253,146 | 5/1966 | De Vries | 250/71 |
| 3,294,559 | 12/1966 | Searight et al. | 106/54 |
| 3,891,451 | 6/1975 | Okazaki et al. | 106/30 |
| 3,998,645 | 12/1976 | Okazaki et al. | 106/30 |
| 4,758,469 | 7/1988 | Lange | 428/325 |

FOREIGN PATENT DOCUMENTS

| | | | |
|---|---|---|---|
| 475061 | 6/1973 | Australia | C09D 5/00 |
| 0162229 | 11/1985 | European Pat. Off. | E01F 9/08 |
| 0466671A2 | 1/1992 | European Pat. Off. | C09D 5/22 |
| 48-39056 | 11/1973 | Japan | E01F 9/04 |
| 53-76699 | 7/1978 | Japan | G09F 13/16 |
| 56-30407 | 7/1981 | Japan | E01C 23/16 |
| 1-93445 | 4/1989 | Japan | C03C 17/32 |
| 3-20424 | 3/1991 | Japan | C09D 5/00 |
| 1324553 | 7/1973 | United Kingdom | C08F 39/00 |
| 2241179A | 8/1991 | United Kingdom | C0/ 39 3C |

OTHER PUBLICATIONS

Peter A. Lewis, Organic Pigments, Federation of Societies for Coatings Technology, pp. 28–29 (Oct., 1988).

Derwent Publication AN 77-65561Y of Japanese Application No. 52 081 532.

Derwent Publication AN 89-160462 of Japanese Application No. 1 101 381.

Abstract of Japanese Patent Kokai 20424/91.

Abstract of Japanese Patent 93445.

*Primary Examiner*—Mark L. Bell

*Assistant Examiner*—Chris Gallo

*Attorney, Agent, or Firm*—Gary L. Griswold; Walter N. Kirn; Karl G. Hanson

[57] ABSTRACT

A pavement marking that has yellow-tinted, retroreflective beads partially embedded in a bead-carrier medium. The bead-carrier medium contains 0.5 to 15 volume percent of a light-scattering agent that scatters white light. The pavement marking is able to retroreflect a distinct yellow color at nighttime without using yellow pigments that contain the potentially-toxic metals, cadmium, chromium, and lead.

28 Claims, 2 Drawing Sheets

YELLOW RETROREFLECTIVE PAVEMENT MARKINGS

TECHNICAL FIELD

This invention pertains to a yellow retroreflective pavement marking that is substantially free of pigments that contain cadmium, chromium, and lead.

BACKGROUND OF THE INVENTION

Yellow and white pavement markings are commonly used on roadways to display traffic lanes. A yellow pavement marking will typically have a different meaning to an automobile driver than a white pavement marking. For example, in the United States of America (USA) a yellow pavement marking is used on a roadway to separate traffic lanes where the traffic moves in opposite directions; whereas a white pavement marking is used (i) to mark the roadway's border at the shoulder, and (ii) to separate traffic lanes where the traffic moves in the same direction (for example, a one-way street). In view of these different functions, it is very important that yellow and white pavement markings are discernible to automobile drivers, particularly at nighttime when visibility is limited. Otherwise, driver confusion may result, creating unsafe driving conditions.

Yellow pavement markings have been made, which are distinctly discernible from white pavement markings under both daytime and nighttime conditions. A typical yellow pavement marking contains clear colorless retroreflective beads partially embedded in a yellow base. The base is made yellow by use of yellow pigments that contain heavy metals such as cadmium, chromium, or lead (see e.g. U.S. Pat. Nos. 2,574,971, 2,268,537, 3,337,483, 4,117,192, 4,248,932, 4,564,556, 4,931,414, Japanese Patent Kokoku 20424/91 and EP 0,305,579 B1). During the daytime, the base diffusely reflects yellow light to display a yellow marking to automobile drivers. At nighttime, the beads reflect light back in the direction from which it came (retroreflect). This retroreflected light is yellow because it strikes the heavy-metal pigments in the base adjacent to the retroreflective beads. The heavy-metal pigments diffusely reflect yellow light back into the beads. The beads then redirect the diffusely scattered yellow light and send it back in the direction of the light source.

Cadmium, chromium, and lead-based pigments have provided good yellow retroreflective pavement markings. Under both daytime and nighttime conditions, the pavement markings are distinctly yellow in appearance. These heavy-metal pigments strongly scatter light because they have a high index of refraction and a particle size on the order of magnitude of the wavelength of light. The pigments provide a distinct yellow color by absorbing the non-yellow components of light to reflect essentially yellow light. This good performance of cadmium, chromium, and lead-based pigments has promoted their widespread use in yellow pavement markings. Chrome yellow (also known as lead chromate) is the most widely used yellow pigment in pavement markings.

It has been known for many years that cadmium, chromium, and lead-based pigments are not environmentally sound. Cadmium, chromium, and lead can be toxic, and therefore replacements have been sought for these pigments. Some states in the USA have announced plans to ban heavy-metals like lead in their pavement markings (A. Banou, Am. Paint & Coatings J. 21-22 (Aug. 19, 1991)). To do so, however, requires that there be suitable replacements for the heavy-metal pigments. The new pavement marking must be highly visible under both daytime and nighttime conditions and must provide a distinct yellow color so as not to be confused with other pavement markings, particularly white pavement markings.

Organic pigments have been recognized as alternatives to heavy-metal pigments (P. Lewis, *Organic Pigments*, Fed. Soc. for Coatings Tech., Philadelphia, Pa. (October 1988); and J. M. Cameron, *Issues and Opportunities in Heavy Metal Replacement*, Am. Chem. Soc. Poly. Tech. Conf., Philadelphia, Pa. (June 1991)). Inventors have attempted to use yellow organic pigments in lieu of yellow heavy-metal pigments in pavement markings (see e.g. U.S. Pat. Nos. 3,891,451 and 3,998,645). This attempt has met with little success commercially because organic pigments generally lack strong light-scattering effects.

It has been known to use colored beads in a pavement marking. Yellow-colored beads have been known as early as 1966, as shown in U.S. Pat. No. 3,294,559 to Searight et al. Notwithstanding this long duration of knowledge, yellow beads have not been used in yellow pavement markings to a significant extent. Rather, the pavement markings have relied on colorless beads and yellow, heavy-metal-containing pigments like chrome yellow. Pavement markings have continued to employ these pigments in spite of the long felt need for alternatives.

Most recently, in Japanese Patent Kokoku 20424/91 (published Mar. 19, 1991) a yellow road marking material has been disclosed which contains yellow transparent glass beads, but still employs chrome yellow as a pigment. The glass beads are made yellow by coating them with a film of a thermosetting resin that contains a yellow dye. This patent discloses that the road marking material contains yellow pigments such as chrome yellow, yellow organic pigments, titanium yellow, and yellow iron oxide. This patent also discloses that colored glass beads have also been prepared by melt mixing metal ions such as nickel, chromium, cobalt, or copper in the transparent glass, but discourages the use of such beads because it is difficult to adjust their color and prescribed light absorptivity, and they are expensive.

SUMMARY OF THE INVENTION

In this invention, a pavement marking is now provided that does not contain cadmium, chromium, or lead, and yet is distinctly yellow and very bright when viewed under nighttime driving conditions. The pavement marking of this invention comprises a plurality of retroreflective beads at least partially embedded in a bead-carrier medium that is free of cadmium, chromium, and lead. The bead-carrier medium contains at least 0.5 volume percent of a light-scattering agent that scatters white light and has an index of refraction greater than about 1.6. The volume percent of light scattering agent is based on solids of the bead-carrier medium, excluding beads and anti-skid particles. The retroreflective beads have a yellow tint that provides the retroreflective pavement marking with a distinct yellow nighttime color that has a sum of chromaticity coordinates x and y greater than 0.95 when tested according to ASTM E 811-87. The pavement marking also exhibits a specific luminance greater than 150 millicandela (mcd) per square meter ($m^2$) per lux (lx) when tested according to ASTM D 4061-89.

This invention also provides a new method of making a retroreflective pavement marking. The method comprises: providing a bead-carrier medium that contains at least 0.5 volume percent of a light-scattering agent that scatters white light, the bead-carrier medium being free of a pigment that contains cadmium, chromium, or lead; and embedding retroreflective beads in the bead-carrier medium, the retroreflective beads having a yellow tint so that when light strikes the yellow-tinted retroreflected beads the pavement marking retroreflects a distinct yellow nighttime color.

In this invention, it has been discovered that by using yellow-tinted retroreflective beads, a distinct yellow nighttime color can be displayed by the pavement marking when the light-scattering agent(s) only scatter(s) white light. There are many white light-scattering agents that do not contain cadmium, chromium, or lead. These metals are commonly used in yellow pigments like lead chromate, lead chromate molybdate, and cadmium sulfide. The combination of yellow-tinted retroreflective beads and a bead-carrier medium that contains a white light-scattering agent provides a pavement marking that is distinctly yellow in color at night and also has a strong luminance. The distinct yellow nighttime color and good luminance is provided without using pigments that contain cadmium, chromium, or lead.

To provide a pavement marking that displays a yellow daytime color, the bead-carrier medium can also contain a colorant that reflects yellow light. This colorant can be an organic yellow pigment.

This invention is not only beneficial in that the use of potentially-toxic pigments is avoided, but it also is beneficial in that a distinct yellow color can be obtained by a method that is less sensitive to variations in the manufacturing process. In prior art methods, the degree of pigment dispersion in the bead-carrier medium and the extent of bead embedment had to be monitored carefully to consistently obtain a distinct yellow nighttime color. This has been alleviated to a significant extent by using yellow-tinted beads and a white light-scattering agent. In addition, this invention is advantageous in that a variety of colorants can be employed in the pavement markings to obtain a yellow daytime color. Prior art pavement markings employed pigments that had strong light-scattering capabilities in conjunction with reflecting distinct yellow nighttime and daytime colors. In this invention, the colorants do not need to have strong light-scattering capabilities. Nor do the colorants have to reflect a distinct yellow nighttime color. Thus, a relatively large number of colorants can be used to obtain the proper daytime color. Therefore, in the context of yellow pavement markings, this invention has substantially broadened the process window (variations in process conditions) and the composition window (variations in pavement marking components).

A pavement marking that has a sum of chromaticity coordinates x and y greater than 0.95 and specific luminance greater than 150 provides a nighttime color that is distinct from a white and is sufficiently bright to be readily noticeable under nighttime driving conditions. Chromaticity coordinates x and y describe points on a chromaticity diagram (see e.g. FIG. 1). A chromaticity diagram is a plot of all of the colors visible to the human eye. The perimeter of the chromaticity diagram outlines the most pure colors; that is, colors that consist only of one wavelength of light. Near the center of the diagram are neutral colors such as white. In regard to nighttime viewing of pavement markings, a sum of the x and y coordinates greater than 0.95 is indicative of a color that is clearly distinct from white. As the term is used herein, "distinct yellow nighttime color" means a pavement marking that exhibits yellow retroreflected light having a sum of chromaticity coordinates x and y greater than 0.95 when tested according to ASTM E 811-87. Preferably, the x and y coordinates fall within a box on the chromaticity diagram; that box is defined by the (x,y) coordinates (0.458, 0.492), (0.480, 0.520), (0.610, 0.390), and (0.560, 0.390) noted by numbers 20–23 respectively in FIG. 1.

ASTM E 811-87 is a standard test for measuring colorimetric characteristics of retroreflectors under nighttime conditions. The test is performed in a laboratory photometric range using a projector light source and a telespectroadiometer. The general procedure involves first measuring the spectrum of the incident light falling on a pavement marking. Then the spectrum of the retroreflected light is measured at an appropriate observation geometry. The reflected spectrum is divided by the incident light spectrum, wavelength by wavelength. The result of this spectral ratio is analyzed in accordance with CIE Publication 15.2 Colorimetry using standard illuminant A (corresponding to a tungsten headlamp on an automobile) and the 1931 two degree standard observer to arrive at chromaticity coordinates (x,y) for nighttime chromaticity. To reproduce this test, the following parameters are defined:

(1) Use procedure B
(2) Observation angle, $\alpha=0.7°$
(3) Entrance angle, $\beta=89°$
(4) Rotation angle, $\epsilon=0°$
(5) Observation distance=20 feet (6.1 m)
(6) Test specimens dimensions and shape: at least 0.1 $m^2$ (typical test specimen size is 4 inches wide (102 mm) and 5 feet (1.52 m) in length (0.16 $m^2$) to provide a compact projected area for measurement)
(7) Receptor angular aperture: 15 minutes of arc
(8) Source angular aperture: 15 minutes of arc
(9) Reference center of the reflector: geometric center of test sample
(10) Reference axis of the reflector: normal to test sample.

Knowing these parameters, a person of ordinary skill in the art can reproduce this test. "ASTM E 811-87" will be used herein to mean ASTM E 811-87 where the above-noted parameters are as provided above. These parameters approximate horizontal pavement marking viewing conditions for a driver of a typical automobile, viewing at a distance of 120 feet (36.6 meters).

ASTM D 4061-89 is a standard test for measuring the retroreflectance of pavement markings. The test involves determining the ratio of retroreflected light at the test surface to incident light on the test surface. From these measurements, the photometric quantity, specific luminance is calculated ("specific luminance"). This quantity corresponds to the visual "brightness" of a test sample as seen by a human observer. For purposes of duplicating this standard test, the observation angle, $\alpha$ is designated to be 1° and the entrance angle, $\beta$ is designated to be 86.5°. Knowing $\alpha$ and $\beta$, ASTM D 4061-89 can be reproduced by a person of ordinary skill in the art. "ASTM D 4061-89" will be used herein to mean the ASTM D 4061-89 test with an $\alpha$ of 1° and a $\beta$ of 86.5°. For convenience, this test can be simulated using a portable retroreflectometer (with $\alpha=1°$ and $\beta=86.5°$) having a shortened optical path provided it is calibrated with an appropriate reference standard measured in accordance with ASTM D 4061-89.

DETAILED DESCRIPTION OF PREFERRED EMBODIMENTS

Figure 1:
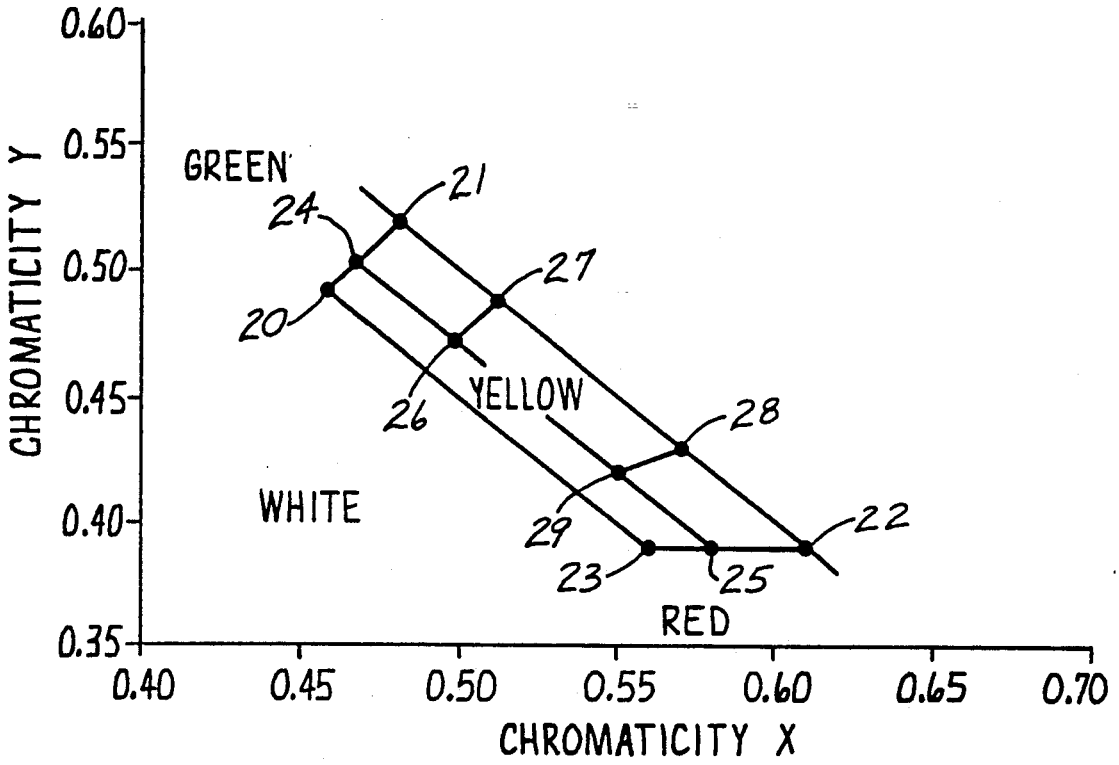
FIG. 1 illustrates a portion of a chromaticity diagram.

In describing the preferred embodiments of this invention, specific terminology will be used for the sake of clarity. The invention, however, is not intended to be limited to the specific terms so selected, and it is to be understood that each term so selected includes all the technical equivalents that operate similarly.

The retroreflective beads used in this invention are yellow-tinted, transparent beads that retroreflect light to provide sufficient illumination at nighttime. Although the beads achieve low refraction of light without the use of a reflective material on the reflective surface of the bead, the beads are termed "retroreflective" because the beads redirect the reflected light and send it back in the direction from which it came. The reflective material can be a light-scattering pigment. A proportion of the light-scattered by the reflective material is collected by the bead and retroreflected. The retroreflective beads average about 25 to 2000 micrometers in diameter, preferably less than about 1,000 micrometers, more preferably 200 to 800 micrometers. The retroreflective beads typically have an index of refraction of from about 1.5 to 2.2, and preferably at least 1.7. For best retroreflection, the beads will have an index of refraction of about 1.9.

The size and index of refraction of beads employed in pavement markings varies widely according to cost and performance requirements. Glass beads having an index of refraction of about 1.9 provide very high brightness but are usually more costly and less durable than 1.5 index beads. Ceramic beads having an index of refraction of 1.7 to 2 have been developed which are quite durable but expensive.

For effective retroreflection, the beads should be embedded from about 40 to 60 percent of their diameter in the bead-carrier medium. Thus, there exists a relationship between the bead size and minimum thickness of the bead-carrier medium. To obtain good brightness under wet conditions, very large 1,000 to 2,000 micrometer beads have been used. Larger beads are more likely to protrude above the surface of water on the marking. Another method of providing wet reflectivity is to form a raised pattern in the bead carrier-medium, and embed the retroreflective beads in the protuberances of the raised pattern.

During retroreflection, the incident light passes through the retroreflective bead(s), and is focused in a region adjacent the bead opposite to where the incident light entered the bead. In this region, the light is scattered by the light-scattering agent, typically in a diffuse fashion. Some of the scattered light is then collected by the bead and is refocused to travel back along its incident path. There must be sufficient light-scattering in the region opposite to where the incident light entered the bead if retroreflection is to be realized.

Retroreflective beads can be made of glass, or they may be made of a non-vitreous ceramic composition. Glass retroreflective beads can be made from known compositions according to conventional processes. Glass beads have been disclosed in the following U.S. Pat. Nos. 1,175,224, 2,461,011, 2,726,161, 2,842,446, 2,853,393, 2,870,030, 2,939,797, 2,965,921, 2,992,122, 3,468,681, 3,946,130, 4,192,576, and 4,367,919, the disclosures of which are incorporated here by reference. Non-vitreous ceramic retroreflective beads can be made according to known methods such as those disclosed in U.S. Pat. Nos. 4,564,556, 4,758,469, 4,772,511, and 4,931,414, the disclosures of which are incorporated here by reference.

Retroreflective beads can be provided with a yellow tint by, for example, incorporating a yellow tinting agent into the retroreflective beads. The term "incorporating" is used here to mean that the tinting agent is part of the internal composition of a retroreflective bead. For example, with glass beads the tinting agent may be an integral part of a single glass phase. A tinting agent is a substance that causes the retroreflective beads to display a yellow color when white light is passed through the beads. The tinting agent, preferably, does not scatter light; that is, it does not cause light passing through a retroreflective bead to deviate substantially from a straight line path. Examples of tinting agents that can be added to retroreflective beads include metals such as cerium, copper, manganese, iron and oxides and combinations thereof.

In addition to incorporating a tinting agent into the retroreflective beads, the retroreflective beads may be provided with a yellow tint by applying a tinting agent to the surface of the beads. For example, in Japanese Patent Kokoku 20424/91 the retroreflective beads are tinted yellow by applying a coating that contains a yellow dye to the outer surface of the beads.

The amount of tinting agent may vary depending on the composition of the retroreflective beads, bead size, index of refraction, amount of light-scattering agent and its ability to scatter light, and the desired retroreflected color. The composition of the retroreflective beads controls the bead's index of refraction. The tinting agent therefore is not normally used to an extent that it has a deleterious effect on the index of refraction. The tinting agent is also not used in such large amounts that luminance is diminished to an extent that the pavement marking is rendered ineffective. The luminance of the retroreflective beads is a function of the transparency of the retroreflective beads and the light-scattering agent's ability to scatter light. When a very strong light-scattering agent is used in the bead-carrier medium (for example, one that has an index of refraction greater than about 2.4), then more tinting agent can be used to color the retroreflective beads. A tinting agent is typically incorporated into the retroreflective beads at 0.5 to 10 weight percent (in some embodiments preferably greater than one percent) based on the weight of the retroreflective beads.

An example of a yellow-tinted glass retroreflective bead has the following composition:

20 to 50 weight percent titanium dioxide;
25 to 50 weight percent barium oxide;
0.5 to 15 weight percent tinting gent (e.g., cerium, copper, manganese, and iron and oxides thereof);
0 to 25 weight percent silica;
0 to 16 weight percent zinc oxide;
0 to 15 weight percent alkali oxides;
0 to 6 weight percent calcium oxide; and
0 to 5 weight percent boria ($B_2O_3$).

Preferred glass beads contain more than one percent tinting agent when cerium oxide is used as the tinting agent, preferably 1.25 to 10 weight percent cerium oxide.

An example of a tinted, non-vitreous ceramic bead has the following composition:

15 to 35 weight percent $SiO_2$;
50 to 80 weight percent $ZrO_2$;
0 to 15 weight percent $Al_2O_3$;
0 to 15 weight percent $TiO_2$; and
0.5 to 15 weight percent (preferably 1.25 to 10 percent) tinting agent.

The bead-carrier medium is a layer of material capable of supporting retroreflective beads. The bead-carrier medium contains a binder and a light scattering agent and optionally fillers, extenders, stabilizers and colorants. The binder can be, for example, a polymeric matrix, a paint, or a solidified polymer melt. The composition of the bead-carrier medium will depend upon the particular application of the pavement marking.

A light-scattering agent is an additive to the bead-carrier medium, which reflects light in a multitude of directions. The light-scattering agent desirably backscatters a portion of the light striking it, causing a reflection of light in the direction from which the light came (that is, from the bead). Some of the backscattered light reenters the bead, and is refocused and redirected towards the originating light source. The light-scattering agent is added to the bead-carrier medium in amounts that permit a sufficient quantity of light-scattering agent to be adjacent to the retroreflective beads. Generally, the light-scattering agent is used in the bead-carrier medium at about 0.5 to 15 volume percent, preferably less than 10 volume percent, based on solids of the bead-carrier medium excluding retroreflective beads and anti-skid particles. The use of a high volume percent of light-scattering agent causes the pavement marking to have a brighter retroreflection, but makes it more difficult to attain a yellow daytime color. Preferred light-scattering agents have an index of refraction greater than 2, more preferably greater than 2.4, and even more preferably greater than 2.6. Preferred light-scattering agents have a particle size of about 0.1 to 2 micrometers, preferably 0.2 to 0.8 micrometers. Examples of light-scattering agents that can be used include pigments that diffusely reflect white light including (but not limited to): zinc based pigments such as zinc oxide, zinc sulfide, and lithophone; ziconium silicate and zirconium oxide; natural and synthetic barium sulfates; titanium dioxide; and combinations thereof. These pigments contain metals other than cadmium, chromium and lead. Titanium dioxide is a preferred light-scattering agent. White pigments are designated in the Colour Index System as pigment whites under the notation "PW".

ASTM E 811-87 is a standard test that can be used to measure the nighttime appearance of a pavement marking exposed to light from an automobile headlamp. Using this test, chromaticity coordinates (x, y) can be derived. These coordinates represent points on a chromaticity diagram. Different points represent different colors. In FIG. 1, a portion of a chromaticity diagram is shown. Points on FIG. 1 with sum of the x and y chromaticity coordinates greater than 0.95 are to the right of line 20–23. Points to the right of line 20–23 represent a color that is distinct from white. Points that are located to the left of line 20–23 display a whiter color, and are more likely to be confused with white pavement markings. Preferred pavement markings have a sum of chromaticity coordinates greater than 0.97. These pavement markings demonstrate chromaticity points to the right of line 24–25. In a preferred embodiment, the pavement marking exhibits a sum of chromaticity coordinates (x, y) that fall within a box defined by points 20–23. When the pavement marking exhibits a yellow color that falls within box 20–23, the color exhibited is discernible from green and red. More preferably, the chromaticity coordinates fall within a box defined by points 21, 22, 24, and 25. In a more preferred embodiment, the chromaticity coordinates fall within a box defined by points 26–29. The most distinct yellow colors fall within box 26–29. The points displayed on FIG. 1 can be summarized as follows:

| | Chromaticity Coordinates | |
|---|---|---|
| Point | x | y |
| 20 | 0.458 | 0.492 |
| 21 | 0.480 | 0.520 |
| 22 | 0.610 | 0.390 |
| 23 | 0.560 | 0.390 |
| 24 | 0.467 | 0.503 |
| 25 | 0.580 | 0.390 |
| 26 | 0.498 | 0.472 |
| 27 | 0.512 | 0.488 |
| 28 | 0.570 | 0.430 |
| 29 | 0.550 | 0.420 |

Pavement markings of this invention have demonstrated a distinct yellow color and a strong luminance without using a pigment that contains cadmium, chromium, or lead. This distinct yellow color has been demonstrated under nighttime conditions without using any yellow pigment in the bead-carrier medium. The pavement markings have also demonstrated a specific luminance greater than 150 mcd per $m^2$ per lx when tested according to ASTM D 4061-89. A specific luminance greater than 350 mcd per $m^2$ per lx can also be obtained with pavement markings of this invention. A specific luminance as high as 2450 mcd per $m^2$ per lx has been demonstrated by pavement markings of this invention.

Yellow pavement markings of this invention can exhibit a specific luminance which is at least 40 percent of the specific luminance of an equivalent white pavement marking. An equivalent white pavement marking means a white pavement marking having the same bead index of refraction, bead size, bead embedment, bead coverage, and product construction, but has colorless or nontinted retroreflective beads.

As a pavement marking of this invention contains a light-scattering agent that returns white light, it is necessary to add a yellow colorant to the bead-carrier medium if a yellow daytime color is desired. The term "yellow colorant" is used herein to mean a coloring agent that provides the pavement marking with a yellow daytime color. The yellow colorant does not contain cadmium, chromium, or lead. The yellow colorant does not have to be a strong light-scattering agent because light-scattering is provided by the white light-scattering agent. Thus, the yellow colorant can have an index of refraction less than about 1.6, and the colorant can be a dye or a pigment such as a yellow organic pigment. Examples of organic yellow pigments include:

(1) C.I. Pigment Yellow 55 (diarylide yellow AAPT), for example, IRGALITE Brand Yellow BAF from Ciba-Geigy, a diarylide-p-toluidide;

(2) C.I. Pigment Yellow 65 (arylide Yellow RN or 3RA), for example, DALAMAR Brand Yellow YT-820-D from Heubach, a monazo;
(3) C.I. Pigment Yellow 74 (arylide yellow GY or brilliant yellow 5GX), for example DALAMAR Brand Yellow YT-808-D from Heubach, a monoazo;
(4) C.I. Pigment Yellow 83 (diarylide yellow HR), for example, DIAZO HR Brand from Hoechst;
(5) C.I. Pigment Yellow 110 (tetrachloroisoindolinone yellow R), for example, IRGAZINE Brand Yellow 3RLTN from CibaGeigy;
(6) C.I. Pigment Yellow 120 (benzimidazolone yellow H2G);
(7) C.I. Pigment Yellow 139 (isoindoline yellow); and
(8) C.I. Pigment Yellow 183 (paliotol yellow).

The yellow colorant is employed in the bead-carrier medium in an amount sufficient to obtain the appropriate daytime color. This amount can vary depending on the properties of the colorant and the desired daytime yellow color. Colorants are typically employed in amounts sufficient to provide chromaticity coordinates within the range of the daytime color specification of the particular government regulation for which the pavement marking is intended to satisfy. For example, in the USA, colorants are used to provide chromaticity coordinates within a Federal Highway Administration (FHWA) yellow color box when tested according to ASTM E 1164-91, a standard daytime color test. Generally, an organic yellow colorant may be added to the bead-carrier medium at about 5 to 40 weight percent based on the weight of the bead-carrier medium.

Pavement markings of this invention may come in a variety of forms. For example, the pavement marking can be a preformed tape, a liquid-applied marking, or a hot-melt-applied thermoplastic marking. The bead-carrier medium may be different for each of these pavement markings.

Preformed tapes are widely known in the pavement marking art. Examples of preformed tapes are disclosed in U.S. Pat. Nos. 4,117,192, 4,248,932, and 4,299,874, and U.S. Application Ser. No. 07/632,976, the disclosures of which are incorporated here by reference. The tapes are referred to as "preformed" because they are not made on-site like liquid-applied markings. An example of a preformed pavement marking tape is shown in FIG. 2 as number 10.

Figure 2:
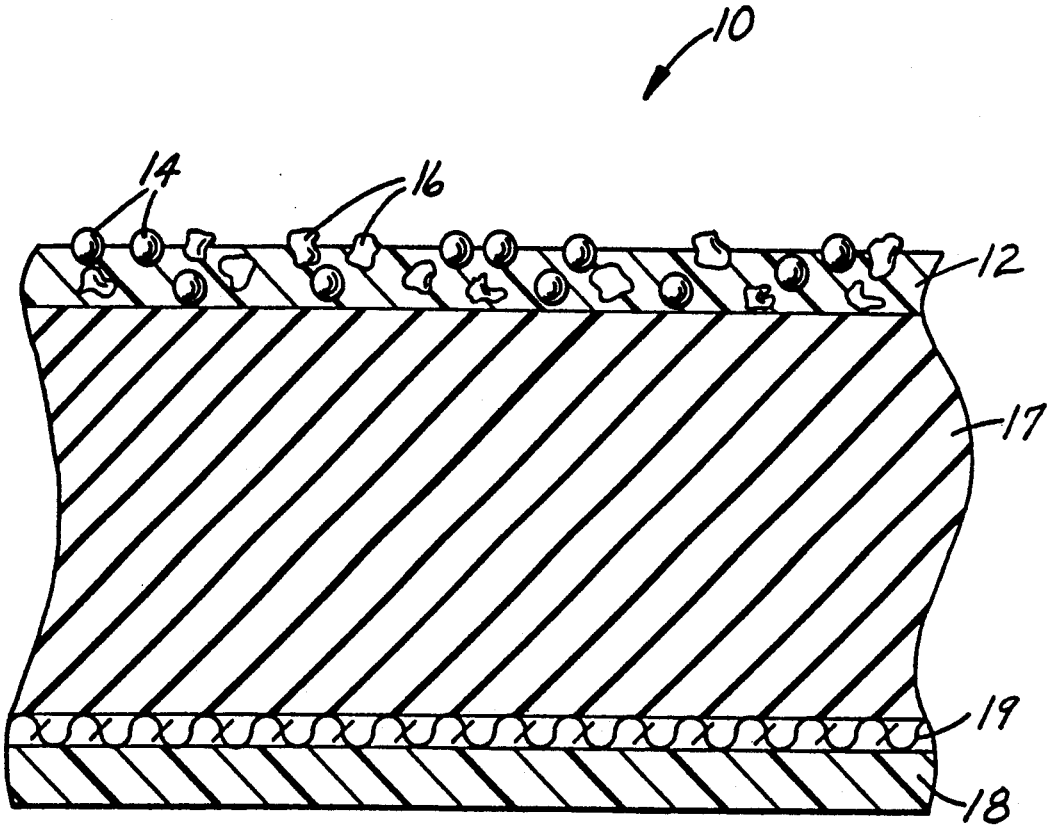
FIG. 2 is an example of a preformed pavement marking.

In FIG. 2, preformed pavement marking tape 10 has, as a bead-carrier medium, a top layer 12 that contains retroreflective beads 14 and optional anti-skid particles 16. An adhesive layer 18 is optionally provided on the bottom side of preformed tape 10. As shown, tape 10 also has a conformance layer 17 and a reinforcing web 19 disposed between the top layer 12 and adhesive layer 18. Conformance layer 17 and reinforcing web 19 are optional.

Top layer 12 may be made of, for example, a polymeric matrix such as polyvinyl chloride (PVC), polyvinyl acetate (PVA), PVC/PVA blends, poly ethylene-co-acrylic acid (EAA), poly ethylene-co-methacrylic acid (EMAA), and EAA/EMAA blends, polyurethane, epoxy resins, melamine resins, and polyamides.

Top layer 12 contains a light-scattering agent and optionally a colorant to impart a desired daytime color thereto. The light-scattering agent is located in top layer 12 in a quantity that permits sufficient light-scattering agent to be adjacent to beads 14. This enables light passing through beads 14 to be scattered. A colorant will typically be used when the light-scattering agent does not reflect the desired daytime color. By selection of particular pigments and adjusting the relative amounts used, pavement markings may be made with a desired daytime yellow color, for example, to satisfy applicable government specifications.

Retroreflective beads 14 typically are randomly scattered throughout top layer 12 and are partially embedded in top layer 12, protruding from the top surface thereof. Some beads (or all of the beads) may be totally embedded in the top surface, becoming exposed as the top layer is progressively eroded away in use. Top layer 12 can also contain anti-skid particles 16 to improve the tire traction on the marking material.

Typically, a preformed pavement marking tape will have a conformance layer 17 disposed between top layer 12 and adhesive layer 18. A typical conformance layer is made of highly filled acrylonitrile butadiene rubber or nitrile, properly filled (e.g., with mineral fillers) to provide desired physical properties such as an appropriate tensile strength, elongation, and conformability.

Adhesive layer 18, which adheres tape 10 to the pavement surface (not shown), is selected to provide desired adhesion properties. For instance, tape 10 may be intended for long-term applications and should thus provide high durability.

In some embodiments, pavement marking tape 10 has an optional reinforcing web 19. Such a web is incorporated into the tape construction to increase the tensile strength and tear resistance of the tape. Such webs are preferred in instances where the tape is intended to be removed after its temporary use on a roadway.

Although the pavement marking illustrated in FIG. 2 is flat, pavement markings having patterned surfaces can also be used. Patterned pavement markings have been disclosed, for example, in U.S. Pat. Nos. 4,388,359, 4,758,469, 4,988,541, and 4,988,555, the disclosures of which are incorporated here by reference.

Pavement markings of this invention can also take the form of liquid-applied coatings. Liquid-applied coatings have been known in the pavement marking art for many years. U.S. Pat. Nos. 2,043,414, 2,440,584, 4,203,878, and 4,856,931 disclose examples of liquid applied coatings. The disclosures of these patents are incorporated here by reference. In a liquid-applied coating, the bead-carrier medium can be a paint. The paint can be applied to the roadway surface and the retroreflective beads can be sprinkled thereon before the paint drys, allowing the beads to become secured to the paint by being partially embedded therein. Alternatively, the retroreflective beads may be added to the paint before it is applied to the roadway surface so that the retroreflective beads become completely embedded in the paint. After the paint has been worn from motor vehicle traffic, the retroreflective beads will become exposed so that they can serve their retroreflective purpose. Anti-skid particles can also be added to the paint before or after the paint is applied to the road.

The paint will contain a light-scattering agent and optionally a yellow colorant. The light-scattering agent and yellow colorant may be any of those discussed above. The amount of yellow colorant can vary depending on the strength of the colorant, the light-scattering agent, and the intended color of the marking.

Hot-melt applied thermoplastic markings are known in the art, and this invention is suitable for use with such markings. Hot-melt-applied thermoplastic markings have been disclosed, for example, in U.S. Pat. Nos. 3,891,451, 3,935,158, and 3,998,645.

A hot-melt-applied thermoplastic markings of this invention may possess a bead carrier medium that can contain a thermoplastic resin as a binder to which a light-scattering agent has been added. The bead-carrier medium can also contain a plasticizer, a stabilizer, an antioxidant, and a filler. A hot-melt-applied thermoplastic marking is put on a roadway by heating the marking composition to temperatures as high as about 150° to 250° C., applying the molten composition to the roadway, and allowing this applied composition to cool. The retroreflective beads may be added to the bead-carrier medium before or after the molten composition is applied to the roadway. When the retroreflective beads are added to the molten composition before it is applied to the roadway surface, most of the beads will be completely embedded in the pavement marking, but will become exposed as the marking is exposed to vehicular traffic.

Features and advantages of this invention are further illustrated in the following examples. It is to be expressly understood, however, that while the examples serve this purpose, the particular ingredients and amounts used as well as other conditions and details are not to be construed in a manner that would unduly limit the scope of this invention.

EXAMPLES

In the following illustrative examples, pavement markings were prepared and tested for retroreflective chromaticity and spectral luminance. The results of the tests are set forth in Table 1.

Except where indicated otherwise, the tinted glass retroreflective beads used in the following examples were prepared by forming a base glass composition that contained 43.5% $TiO_2$, 29.3% BaO, 14.3% $SiO_2$, 8.4% $Na_2O$, 3.1% $B_2O_3$ and 1.4% $K_2O$ by weight. To this cerium oxide was added in the form of a 96 weight percent cerium oxide concentrate available from Molycorp, Inc. of White Plains, N.Y. as Molycorp 5310. In example 30, copper was added to the base glass composition in the form of copper metal. In the examples where colorless 1.9 index glass bead were used, these beads were obtained from Flex-O-Lite, Inc., St. Louis, Mo.

In example 36, yellow non-vitreous ceramic microspheres were prepared by adding a tinting agent to a base composition of 12.6 weight percent $SiO_2$, 77.7 wt. % $ZrO_2$, and 9.7 wt. % $Al_2O_3$. Iron was added in the form of an iron salt solution to the ceramic sol precursors at a level to yield a non-vitreous ceramic bead containing 1.5% $Fe_2O_3$.

FLAT-SURFACE PAVEMENT MARKINGS

EXAMPLE 1

A bead-carrier medium was prepared as follows. Pellets of Nucrel 699 an EMAA copolymer available from E.I. Dupont de Nemours, Wilmington, Del. and of a first pigment concentrate (30 wt. % Cal Lake Yellow, Colour Index PY 183, in ethylene acrylic acid copolymer Primacor 3150 from Dow Chemical, Midland, Mich., concentrate 1042276 EUVAO from Spectrum Colors, Minneapolis, Minn.) and of a second pigment concentrate (50 wt. % titanium dioxide pigment in an EAA copolymer, Spectratech IM 88947, from USI Division, Quantum Chemical Company, Clinton, Mass.) were tumbled in a pail tumbler to provide a uniformly distributed pellet mixture with a yellow pigment content of 8.7 wt. %, a titanium dioxide content of 5.8 wt. %, an EAA content of 26.2 wt. % and an EMAA content of 59.3 wt. %. This mixture was extruded through a film die onto a polyester carrier web using a Killion single screw extruder to provide a pigmented top layer or bead-carrier medium for a conformable marking sheet about 220 to 230 micrometers (μm) in thickness.

The top layer on the carrier web was carried over the surface of a hot can heated to a temperature of 210° C., (for example, sufficiently hot to bring the pigmented top layer material to a softened, nearly molten, condition, but not so hot that the polyester carrier web would melt). While in contact with the hot can at the elevated temperature, colorless glass retroreflective beads (200 to 600 μm in size, 1.9 index of refraction, surface treated with γ-aminopropyl triethoxy silane) and small particles of aluminum oxide grit (nominal particle size of 600 μm) were sprinkled onto the hot surface of the top layer. Particle coating was at a level of about 210 grams (g) per $m^2$ of retroreflective glass beads and about 40 $g/m^2$ of aluminum oxide grit as anti-skid particles. The pigmented top layer, with the particles on its surface, was maintained at the high temperature by contact with the hot can with the web moving at a speed of 4 feet per minute (0.02 m/sec).

The particles partially sank or embedded into the surface of the polymer and the polymer appeared to creep up the sides of the particles somewhat during this time. The web was then passed over a cooler roll to resolidify the film containing reflective elements and anti-skid particles.

The polyester carrier web was stripped from the bottom of the polymer film containing the retroreflective beads and anti-skid particles. A layer of rubber resin pressure sensitive adhesive with a thickness of about 125 μm was laminated to the bottom side of the film which had been in contact with the polyester carrier web to provide a self-adhesive reflective marking sheet.

EXAMPLE 2

Same as example 1, except the bead-carrier medium had the following composition: 20 wt. % $TiO_2$ (5.54 vol. %); 20 wt. % EAA; 60 wt. % EMMA.

EXAMPLE 3

Same as example 1, except the bead-carrier medium was about 115 micrometers thick and was extruded onto a conformance layer. The conformance layer was prepared by feeding pellets of Dowlex 4001 ultra low density polyethylene (available from Dow Chemical) and Hubercarb Q3T calcium carbonate powder (available from J.M. Huber Corporation) into the throat of a Baker-Perkin twin screw compounder by means of dry powder screw conveyers with feed rates such that the resultant mixture of materials was in a ratio of 70 to 30 by volume. The twin screw compounder was provided with heating capability to allow melting of the polymer and mixing and dispersion of the solid into the polymer. The mixture was extruded through a strand die into a water bath for cooling. The cooled strands were chopped using a Jetro Pelletizer. The pellets were dried and extruded through a film die using a Killion single screw extruder onto a polyester carrier web to form a 250 micrometer thick conformance layer material on a carrier web. The bead-carrier medium (on the conformance layer) was coated with retroreflective beads and anti-skid particles as described in example 1.

EXAMPLE 4

Same as example 1, except the bead-carrier medium contained: 2.4 wt. % $TiO_2$ (0.61 vol. %); 29.5 wt. % EAA; 56.5 wt. % EMMA; and 11.6 wt. % PY183.

EXAMPLE 5

Same as example 4, except the retroreflective beads were tinted with 1.25 wt. % $CeO_2$ and the anti-skid particles were omitted.

EXAMPLE 6

Same as example 5, except the beads contained 2.5 wt. % $CeO_2$.

EXAMPLE 7

Same as example 6, except the beads contained 3.75 wt. % $CeO_2$.

EXAMPLE 8

Same as example 1, except that the bead-carrier medium contained: 2.3 wt. % $TiO_2$ (0.58 vol. %); 12.2 wt. % PY183; 30.5 wt. % EAA; and 55 wt. % EMAA.

EXAMPLE 9-11

Same as example 8, except retroreflective beads contained 1.0, 1.8, and 2.5 wt. % $CeO_2$ as a tinting agent, respectively.

EXAMPLE 12-14

Same as example 2, except retroreflective beads contained 1.0, 1.8, and 2.5 wt. % $CeO_2$ as a tinting agent, respectively.

EXAMPLE 15

Same as example 3, except the bead-carrier medium contained 2.3 wt. % light-scattering agent and 12.2 wt. % colorant, and the retroreflective beads contained 1.8 wt. % $CeO_2$ as a tinting agent.

EXAMPLE 16

Same as example 1, except the pavement marking contained 2.3 wt. % light-scattering agent and 12.2 wt. % colorant, and the retroreflective beads contained 1.8 wt. % $CeO_2$ as a tinting agent.

EXAMPLE 17

Same as example 8, except that there were no anti-skid particles on the pavement marking, and the retroreflective beads were in the 200-350 micrometer size range.

EXAMPLE 18-20

Same as example 17, except the composition of the retroreflective beads was as follows:

| Wt. % | Component |
|---|---|
| 34.5 | $TiO_2$ |
| 47 | BaO |
| 4 | CaO |
| 0.5 | $Na_2O$ |
| 11.5 | $SiO_2$ |
| 2 | $B_2O_3$ |
| 0.5 | ZnO |

To this base glass $CeO_2$ was added at 0.5, 1.0, and 2.5 wt. %, respectively.

EXAMPLES 21-23

Same as examples 18-20, respectively, except the base glass composition was as follows:

| Wt. % | Component |
|---|---|
| 35 | $TiO_2$ |
| 44 | BaO |
| 2 | CaO |
| 0.5 | $Na_2O$ |
| 11.5 | $SiO_2$ |
| 1 | $B_2O_3$ |
| 5 | ZnO |

To this base glass $CeO_2$ was added at 0.5, 1.0, and 2.5 wt. %, respectively.

EXAMPLES 24-26

Same as examples 18-20, respectively, except the base glass composition is as follows:

| Wt. % | Component |
|---|---|
| 37 | $TiO_2$ |
| 30.5 | BaO |
| 5 | CaO |
| 1.5 | $Na_2O$ |
| 11 | $SiO_2$ |
| 15 | ZnO |

To this base glass $CeO_2$ was added at 0.5, 1.0, and 2.5 wt. %, respectively.

EXAMPLES 27-29

Same as examples 18-20, respectively, except the base glass composition is as follows:

| Wt. % | Component |
|---|---|
| 39 | $TiO_2$ |
| 28 | BaO |
| 6 | CaO |
| 1 | $Na_2O$ |
| 9 | $SiO_2$ |
| 1 | $B_2O_3$ |
| 16 | ZnO |

To this base glass $CeO_2$ was added at 0.5, 1.0, and 2.5 wt. %, respectively.

EXAMPLE 30

Same as example 17, except the retroreflective beads contained 2 wt. % copper as a tinting agent.

EXAMPLE 31

The thermoplastic powder component of white 3M Brand GREENLITE Powder 2110 flame applied pavement marking, a titanium dioxide pigmented thermoplastic polyamide in finely divided particulate form (the same as the pigmented thermoplastic-based particles of Example 1 of U.S. Pat. No. 3,849,351 except that the polyamide reaction product of polymerized fatty acid and alkylene diamine was Eurelon 930 made by Sherex Chemical Company of Dublin, Ohio, USA) was mixed with the glass microspheres having 1.8 wt. % $CeO_2$ as a tinting agent. This mixture was aspirated through a propane gas flame and was deposited according to the method of Harrington, U.S. Pat. No. 3,410,185 onto a flat aluminum test panel surface to produce a retroreflective pavement marking on an aluminum test panel.

EXAMPLE 32

Same as example 31, except 3M brand GREENLITE powder 2110 was used as received with all components.

PATTERNED PAVEMENT MARKINGS

EXAMPLE 33

A pavement marking was prepared using a urethane resin as a bead-carrier medium. The urethane resin was prepared according to U.S. Pat. No. 4,988,555, column 4, lines 37–45, and was pigmented with $PbCrO_4$ (27 wt. %) as described in the same patent at column 4, lines 45–50. A raised patterned base sheet was provided as described in U.S. Pat. No. 4,988,555, column 2, line 62 to column 3, line 52. The urethane was applied to selective portions as described in U.S. Pat. No. 4,988,555 at column 3, lines 53–66 and illustrated in FIG. 4*a*. Colorless retroreflective beads having a non-vitreous ceramic composition as described in U.S. Pat. No. 4,772,511 (150–280 micrometers) were dropped onto the urethane resin prior to its cure, and excess beads were removed after curing.

EXAMPLES 34–35

A pavement marking was prepared as described in example 33 except retroreflective glass beads were used that contained 1.8 wt. % and 2.5 wt. % $CeO_2$, respectively, as a tinting agent.

EXAMPLE 36

Same as example 33, except the urethane resin was pigmented with $TiO_2$ in lieu of lead chromate, and the retroreflective beads (175–210 μm) contained 1.5 wt. % $Fe_2O_3$ as a tinting agent.

EXAMPLES 37 and 38

Same as example 36, except the retroreflective beads were glass and contained 1.8 wt. % and 2.5 wt. % $CeO_2$, respectively, as a tinting agent.

COMMERCIALLY AVAILABLE PAVEMENT MARKINGS

EXAMPLE 39–50

These examples demonstrate the nighttime color and luminance of some commercially-available pavement markings.

TABLE 1

| Examples | Light Scattering Agent | Wt. % | Vol. % | Colorant | Colorant Wt. % | Bead Composition | Tinting Agent | x | y | x + y | Specific Luminance |
|---|---|---|---|---|---|---|---|---|---|---|---|
| 1* | $TiO_2$ | 5.8 | 1.5 | PY 183 | 8.7 | 1.9 glass | none | 0.490 | 0.448 | 0.938 | 843 |
| 2* | $TiO_2$ | 20.0 | 5.5 | | | 1.9 glass | none | 0.452 | 0.418 | 0.870 | 1060 |
| 3* | $TiO_2$ | 5.8 | 1.5 | PY 183 | 8.7 | 1.9 glass | none | 0.456 | 0.419 | 0.875 | 645 |
| 4* | $TiO_2$ | 2.4 | 0.61 | PY 183 | 11.6 | 1.9 glass | none | 0.478 | 0.446 | 0.924 | 739 |
| 5 | $TiO_2$ | 2.4 | 0.61 | PY 183 | 11.6 | 1.9 glass | 1.25% $CeO_2$ | 0.505 | 0.450 | 0.955 | 504 |
| 6 | $TiO_2$ | 2.4 | 0.61 | PY 183 | 11.6 | 1.9 glass | 2.5% $CeO_2$ | 0.534 | 0.453 | 0.987 | 469 |
| 7 | $TiO_2$ | 2.4 | 0.61 | PY 183 | 11.6 | 1.9 glass | 3.75% $CeO_2$ | 0.531 | 0.429 | 0.960 | 462 |
| 8* | $TiO_2$ | 2.3 | 0.58 | PY 183 | 12.2 | 1.9 glass | none | 0.494 | 0.455 | 0.949 | 677 |
| 9 | $TiO_2$ | 2.3 | 0.58 | PY 183 | 12.2 | 1.9 glass | 1.0% $CeO_2$ | 0.519 | 0.444 | 0.963 | 724 |
| 10 | $TiO_2$ | 2.3 | 0.58 | PY 183 | 12.2 | 1.9 glass | 1.8% $CeO_2$ | 0.520 | 0.440 | 0.960 | 660 |
| 11 | $TiO_2$ | 2.3 | 0.58 | PY 183 | 12.2 | 1.9 glass | 2.5% $CeO_2$ | 0.532 | 0.447 | 0.979 | 680 |
| 12 | $TiO_2$ | 20.0 | 5.5 | | | 1.9 glass | 1.0% $CeO_2$ | 0.525 | 0.443 | 0.968 | 1510 |
| 13 | $TiO_2$ | 20.0 | 5.5 | | | 1.9 glass | 1.8% $CeO_2$ | 0.530 | 0.440 | 0.970 | 1430 |
| 14 | $TiO_2$ | 20.0 | 5.5 | | | 1.9 glass | 2.5% $CeO_2$ | 0.541 | 0.437 | 0.978 | 1250 |
| 15 | $TiO_2$ | 2.3 | 0.59 | PY 183 | 12.2 | 1.9 glass | 1.8% $CeO_2$ | 0.530 | 0.443 | 0.973 | 650 |
| 16 | $TiO_2$ | 2.3 | 0.59 | PY 183 | 12.2 | 1.9 glass | 1.8% $CeO_2$ | 0.542 | 0.445 | 0.987 | 662 |
| 17* | $TiO_2$ | 2.3 | 0.59 | PY 183 | 12.2 | 1.9 glass | none | 0.490 | 0.451 | 0.941 | 569 |
| 18 | $TiO_2$ | 2.3 | 0.59 | PY 183 | 12.2 | 1.9 glass | 0.5% $CeO_2$ | 0.492 | 0.444 | 0.936 | 474 |
| 19 | $TiO_2$ | 2.3 | 0.59 | PY 183 | 12.2 | 1.9 glass | 1.0% $CeO_2$ | 0.516 | 0.452 | 0.968 | 407 |
| 20 | $TiO_2$ | 2.3 | 0.59 | PY 183 | 12.2 | 1.9 glass | 2.5% $CeO_2$ | 0.520 | 0.442 | 0.962 | 524 |
| 21 | $TiO_2$ | 2.3 | 0.59 | PY 183 | 12.2 | 1.9 glass | 0.5% $CeO_2$ | 0.496 | 0.444 | 0.940 | 437 |
| 22 | $TiO_2$ | 2.3 | 0.59 | PY 183 | 12.2 | 1.9 glass | 1.0% $CeO_2$ | 0.504 | 0.440 | 0.944 | 474 |
| 23 | $TiO_2$ | 2.3 | 0.59 | PY 183 | 12.2 | 1.9 glass | 2.5% $CeO_2$ | 0.542 | 0.444 | 0.986 | 457 |
| 24 | $TiO_2$ | 2.3 | 0.59 | PY 183 | 12.2 | 1.9 glass | 0.5% $CeO_2$ | 0.502 | 0.448 | 0.950 | 435 |
| 25 | $TiO_2$ | 2.3 | 0.59 | PY 183 | 12.2 | 1.9 glass | 1.0% $CeO_2$ | 0.506 | 0.437 | 0.943 | 454 |
| 26 | $TiO_2$ | 2.3 | 0.59 | PY 183 | 12.2 | 1.9 glass | 2.5% $CeO_2$ | 0.551 | 0.435 | 0.986 | 442 |
| 27 | $TiO_2$ | 2.3 | 0.59 | PY 183 | 12.2 | 1.9 glass | 0.5% $CeO_2$ | 0.496 | 0.434 | 0.930 | 373 |
| 28 | $TiO_2$ | 2.3 | 0.59 | PY 183 | 12.2 | 1.9 glass | 1.0% $CeO_2$ | 0.536 | 0.452 | 0.988 | 417 |
| 29 | $TiO_2$ | 2.3 | 0.59 | PY 183 | 12.2 | 1.9 glass | 2.5% $CeO_2$ | 0.554 | 0.432 | 0.986 | 323 |
| 30 | $TiO_2$ | 2.3 | 0.59 | PY 183 | 12.2 | 1.9 glass | 2% Cu | 0.587 | 0.407 | 0.994 | 381 |
| 31 | $TiO_2$ | 30.0 | 9.1 | | | 1.9 glass | 1.8% $CeO_2$ | 0.518 | 0.439 | 0.957 | 633 |
| 32* | $TiO_2$ | 30.0 | 9.1 | | | 1.5 glass | none | 0.427 | 0.406 | 0.833 | 120 |
| 33* | $PbCrO_4$ | | | $PbCrO_4$ | 26.7 | 1.9 ceramic | none | 0.523 | 0.454 | 0.977 | 1050 |
| 34** | $PbCrO_4$ | | | $PbCrO_4$ | 26.7 | 1.9 glass | 1.8% $CeO_2$ | 0.530 | 0.450 | 0.980 | 2450 |
| 35** | $PbCrO_4$ | | | $PbCrO_4$ | 26.7 | 1.9 glass | 2.5% $CeO_2$ | 0.530 | 0.447 | 0.977 | 2260 |
| 36 | $TiO_2$ | 26.7 | 7.9 | | | 1.9 ceramic | 1.5% $Fe_2O_3$ | 0.520 | 0.432 | 0.952 | 1060 |
| 37 | $TiO_2$ | 26.7 | 7.9 | | | 1.9 glass | 1.8% $CeO_2$ | 0.525 | 0.448 | 0.973 | 2450 |
| 38 | $TiO_2$ | 26.7 | 7.9 | | | 1.9 glass | 2.5% $CeO_2$ | 0.512 | 0.442 | 0.954 | 1870 |
| 39[a]* | $TiO_2$ | | | | | 1.5 glass | none | 0.452 | 0.414 | 0.866 | 467 |
| 40[b]* | $PbCrO_4$ | | | $PbCrO_4$ | | 1.5 glass | none | 0.511 | 0.441 | 0.952 | 296 |
| 41[c]* | $TiO_2$ | | | | | 1.75 glass | none | | | | 519 |
| 42[d]* | $PbCrO_4$ | | | $PbCrO_4$ | | 1.75 glass | none | 0.486 | 0.436 | 0.922 | 437 |
| 43[e]* | $TiO_2$ | | | | | 1.75 ceramic | none | | | | 1000 |
| 44[f]* | $PbCrO_4$ | | | $PbCrO_4$ | | 1.75 ceramic | none | 0.501 | 0.458 | 0.959 | 782 |
| 45[g]* | $PbCrO_4$ | | | $PbCrO_4$ | | 1.75 ceramic | none | 0.511 | 0.447 | 0.958 | 1150 |
| 46[h]* | $PbCrO_4$ | | | $PbCrO_4$ | | 1.9 glass | none | 0.523 | 0.463 | 0.986 | 761 |
| 47[i]* | $PbCrO_4$ | | | $PbCrO_4$ | | 1.9 glass | none | 0.515 | 0.454 | 0.969 | 1320 |

TABLE 1-continued

| Examples | Light Scattering Agent | Wt. % | Vol. % | Colorant | Colorant Wt. % | Bead Composition | Tinting Agent | x | y | x + y | Specific Luminance |
|---|---|---|---|---|---|---|---|---|---|---|---|
| 48[j]* | $TiO_2$ | | | | | 1.9 glass | none | 0.453 | 0.414 | 0.867 | 1560 |
| 49[k]* | $PbCrO_4$ | | | $PbCrO_4$ | | 1.9 glass | none | 0.521 | 0.454 | 0.975 | 1080 |
| 50[l]* | $TiO_2$ | | | PY83 | | 1.9 glass | none | 0.494 | 0.426 | 0.920 | 476 |

*These are comparative examples that employ clear retroreflective beads

**These are comparative examples that employ colored retroreflective beads and $PbCrO_4$ as a light scattering agent.

[a]3M Brand STAMARK TM 5730 Series Pavement Marking Tape

[b]3M Brand STAMARK TM 5731 Series Pavement Marking Tape

[c]3M Brand STAMARK TM 350 Series Pavement Marking Tape

[d]3M Brand STAMARK TM 351 Series Pavement Marking Tape

[e]3M Brand STAMARK TM 380 Series Pavement Marking Tape

[f]3M Brand STAMARK TM 381 Series Pavement Marking Tape

[g]3M Brand STAMARK TM 389 Series Pavement Marking Tape

[h]3M Brand SCOTCHLANE TM 5161 Series Pavement Marking Tape

[i]3M Brand SCOTCHLANE TM 5381 Series Pavement Marking Tape

[j]3M Brand SCOTCHLANE TM 5710 Series Pavement Marking Tape

[k]3M Brand SCOTCHLANE TM 5711 Series Pavement Marking Tape

[l]3M Brand SCOTCHLANE TM 651 Series Pavement Marking Tape, lead free colorant system The data in Table 1 demonstrate that good nighttime yellow color and good luminance can be obtained from pavement markings that employ a white light-scattering agent and yellow-tinted retroreflective beads.

Various modifications and alterations of this invention will become apparent to those skilled in the art without departing from the scope and spirit of this invention. It therefore should be understood that this invention is not to be unduly limited to the illustrated embodiments set forth above but is to be controlled by the limitations set forth in the claims and any equivalents thereof. It is also to be understood that this invention may be suitably practiced in the absence of any element not specifically disclosed herein.

What is claimed is:

1. A retroreflective pavement marking, which comprises:

(a) a bead-carrier medium that is free of cadmium, chromium, and lead and contains a yellow colorant and at least 0.5 volume percent of a light-scattering agent that scatters white light and has an index of refraction greater than 1.6, the volume percent being based on solids of the bead-carrier medium excluding beads and anti-skid particles; and (b) a plurality of retroreflective beads at least partially embedded in the bead carrier medium, the plurality of retroreflective beads having a yellow tint that provides the retroreflective pavement marking with a distinct yellow nighttime color that has a sum of chromaticity coordinates x and y greater than 0.95 when tested according to ASTM E 811-87, the pavement marking also exhibiting a specific luminance greater than 150 millicandela per square meter per lux when tested according to ASTM D 4061-89.

2. The retroreflective pavement marking of claim 1, wherein the light-scattering agent has an index of refraction greater than 2 and includes pigment particles that have average sizes ranging from 0.1 to 2 micrometers.

3. The retroreflective pavement marking of claim 1, wherein the light-scattering agent has an index of refraction greater than 2.4 and has average sizes ranging 0.2 to 0.8 micrometers.

4. The retroreflective pavement marking of claim 1, wherein the light-scattering agent includes pigment particles selected from the group consisting of zinc oxide, zinc sulfide, lithophone, zircon, zirconium oxide, barium sulfate, titanium dioxide, and combinations thereof.

5. The retroreflective pavement marking of claim 4, wherein the $TiO_2$ pigment particles are present in the bead-carrier medium at 0.5 to 10 volume percent, and have particle sizes ranging from 0.2 to 0.8 micrometers.

6. The retroreflective pavement marking of claim 1, wherein the light-scattering agent has an index of refraction greater than 2 and is present in the bead-carrier medium at 0.5 to 15 volume percent.

7. The retroreflective pavement marking of claim 1, wherein the retroreflective beads have greater than one weight percent of a tinting agent incorporated therein.

8. The retroreflective pavement marking of claim 7, wherein the retroreflective beads have 1.25 to 6 weight percent of cerium oxide incorporated therein.

9. The retroreflective pavement marking of claim 1, wherein the retroreflective beads contain copper or an oxide thereof at 0.5 to 2.5 weight percent copper based on the weight of the retroreflective beads.

10. The retroreflective pavement marking of claim 1, having the sum of chromaticity coordinates greater than 0.97.

11. The retroreflective pavement marking of claim 1 having chromaticity coordinates that fall within a box defined by points (0.458, 0.492), (0.480, 0.520), (0.610, 0.390), and (0.560, 0.390).

12. The retroreflective pavement marking of claim 11 having chromaticity coordinates that fall within a box defined by points (0.467, 0.503), (0.480, 0.520), (0.610, 0.390), and (0.580, 0.390).

13. The retroreflective pavement marking of claim 12 having chromaticity coordinates that fall within a box defined by points (0.498, 0.472), (0.512, 0.488), (0.570, 0.430), and (0.550, 0.420).

14. The retroreflective pavement marking of claim 1, which exhibits a specific luminance which is at least 40 percent of the specific luminance of an equivalent white pavement marking.

15. A retroreflective pavement marking, which comprises:

(a) a bead-carrier medium that is free of cadmium, chromium, and lead and contains a yellow colorant a light-scattering agent that scatters white light in an amount sufficient to provide the pavement marking with a specific luminance of at least 150 millacandela per square meter lux when tested according to ASTM D 4061-89; and (b) a plurality of retroreflective beads at least partially embedded in the bead carrier medium, the plurality of retroreflective beads having greater than one weight percent of a tinting agent incorporated therein to provide the pavement marking with a distinct yellow color under nighttime conditions.

16. The retroreflective pavement marking of claim 15, wherein the retroreflective beads contain a tinting agent selected from the group consisting of cerium, copper, manganese, iron, and oxides and combinations thereof.

17. The retroreflective pavement marking of claim 16, wherein the tinting agent is present at 1.25 to 10 weight percent based on the weight of the retroreflective beads.

18.The retroreflective pavement marking of claim 17, wherein cerium oxide is present in the retroreflective beads at 1.25 to 3.75 weight percent.

19. A retroreflective pavement marking, which comprises:

a bead-carrier medium that contains a yellow colorant and at least 0.5 volume percent of a pigment that diffusely scatters white light, the bead carrier medium being free of a pigment that contains cadmium, chromium or lead and having retroreflective beads at least partially embedded in a surface of the bead carrier medium, the retroreflective beads having a yellow tinting agent incorporated therein at about 1.25 to 10 weight percent based on the weight of the retroreflective beads.

20. A method of making a retroreflective pavement marking, which comprises:

(a) providing a bead-carrier medium that contains a yellow colorant and at least 0.5 volume percent of a light-scattering agent that scatters white light, the bead-carrier medium being free of a pigment that contains cadmium, chromium, or lead; and (b) embedding retroreflective beads in the bead-carrier medium, the retroreflective beads having a yellow tint so that when light strikes the yellow-tinted retroreflected beads the pavement marking retroreflects a distinct yellow color.

21. A method of retroreflecting a distinct yellow color from a pavement marking that does not contain cadmium, chromium, or lead, which method comprises:

shining light from an automobile headlamp onto a pavement marking that has a plurality of retroreflective beads partially embedded in a bead-carrier medium, wherein the retroreflective beads have a yellow tint, and the bead carrier medium contains a yellow colorant and at least 0.5 volume percent of a light-scattering agent that scatters white light and is free of a pigment that contains cadmium, chromium and lead.

22. The retroreflective pavement marking of claim 1, wherein the yellow colorant has an index of refraction less than 1.6.

23. The retroreflective pavement marking of claim 1, wherein the yellow colorant is selected from the group consisting of C. I. Pigment Yellow 55, C. I. Pigment Yellow 65, C. I. Pigment Yellow 74, C. I. Pigment Yellow 83, C. I. Pigment Yellow 110, C. I. Pigment Yellow 120, C. I. Pigment Yellow 139, C. I. Pigment Yellow 183, and combinations thereof.

24. The retroreflective pavement marking of claim 1, which provides chromaticity coordinates within a Federal Highway Administration Yellow Color Box when tested according to ASTM E 1164-91.

25. The retroreflective pavement marking of claim 1, wherein the yellow colorant is added to the bead-carrier medium at about 5 to 40 weight percent.

26. The retroreflective pavement marking of claim 1, exhibiting a specific luminance greater than 350 millicandela per square meter per lux.

27. A retroreflective pavement marking, which comprises:

(a) a bead-carrier medium that is free of cadmium, chromium, and lead and contains a yellow colorant and at least 0.5 volume percent of a light scattering agent that scatters white light and has an index of refraction greater than 1.6, the volume percent of light scattering agent being based on solids of the bead-carrier medium excluding beads and anti-skid particles; and (b) a plurality of retroreflective beads having a yellow tint and being at least partially embedded in the bead carrier medium.

28. The retroreflective pavement marking of claim 27, wherein the light scattering agent includes $TiO_2$ pigment particles which are present in the bead-carrier medium at 0.5 to 10 volume percent and which have particle sizes ranging from 0.2 to 0.8 micrometers, and wherein the yellow colorant is a yellow organic pigment that is added to the bead carrier medium at 5 to 40 weight percent

* * * * *

UNITED STATES PATENT AND TRADEMARK OFFICE

CERTIFICATE OF CORRECTION

PATENT NO. : 5,286,682

DATED : February 15, 1994

INVENTOR(S) : Gregory F. Jacobs et al.

It is certified that error appears in the above-identified patent and that said Letters Patent is hereby corrected as shown below:

Col. 4, line 28, insert --filament-- before "headlamp".

Col. 4, line 59, insert --is also known internationally as the "coefficient of retroreflected luminance")-- before ")".

Signed and Sealed this

Twenty-eighth Day of June, 1994

*Attest:*

*Attesting Officer*

BRUCE LEHMAN

*Commissioner of Patents and Trademarks*